US006349421B2

(12) United States Patent
Fukasawa et al.

(10) Patent No.: US 6,349,421 B2
(45) Date of Patent: Feb. 26, 2002

(54) SWIMMING GOGGLES

(75) Inventors: Shunji Fukasawa; Hiromasa Satou, both of Tokyo (JP)

(73) Assignee: Tabata Co., Ltd., Tokyo (JP)

( * ) Notice: Subject to any disclaimer, the term of this patent is extended or adjusted under 35 U.S.C. 154(b) by 0 days.

(21) Appl. No.: 09/915,386

(22) Filed: Jul. 27, 2001

(30) Foreign Application Priority Data

Jul. 31, 2000 (JP) ..... 2000-232107

(51) Int. Cl.[7] ..... A61F 9/02
(52) U.S. Cl. ..... 2/428; 2/452
(58) Field of Search ..... 2/426, 439, 440, 2/441, 442, 448, 450, 452, 428, 430, 429, 447, 445; 351/43; 24/174, 186

(56) References Cited

U.S. PATENT DOCUMENTS 4,527,292 A * 7/1985 Kasama et al. ..... 2/428
4,607,398 A * 8/1986 Faulconer ..... 2/428
5,181,280 A * 1/1993 Zachry, Jr. ..... 2/428
5,459,882 A * 10/1995 Yamamoto ..... 2/428
5,515,551 A * 5/1996 Yashiro ..... 2/425
5,950,248 A * 9/1999 Kawashima et al. ..... 2/428
5,956,778 A * 9/1999 Godoy ..... 2/428
6,112,334 A * 9/2000 Chiang ..... 2/428
6,243,882 B1 * 6/2001 Kawashima et al. ..... 2/428

FOREIGN PATENT DOCUMENTS

JP 64-4372 2/1989

* cited by examiner

*Primary Examiner*—Danny Worrell
(74) *Attorney, Agent, or Firm*—Clark & Brody

(57) ABSTRACT

Swimming goggles includes a fastener part provided at a rear end of each lens frame of the swimming goggles for holding an end of a head strap firmly in position. The fastener part includes a guide member around which the head strap can be passed and a protrusion. The head strap has at its end a plurality of through-holes arranged in a lengthwise direction of the head strap for receiving the protrusion.

4 Claims, 4 Drawing Sheets

SWIMMING GOGGLES

BACKGROUND OF THE INVENTION

This invention relates to swimming goggles worn for swimming or the like.

Japanese Utility Model Publication No. Sho 64-4372 discloses swimming goggles which include a buckle for fastening a head strap to a rear end of a lens frame in a length adjustable manner. This head strap is made from an elastically stretchable material and is at its each end passed through a series of holes provided in the buckle while folded several times so that the head strap is pressed firmly against itself and held in position.

The difficulty encountered in the above-described prior swimming goggles has been that the repetitive stretch and contraction of the head strap during a long-term use sometimes causes its folds to get loose to the extent that requires readjustment of the operative length of head strap. Also, it has been difficult to effect precise length adjustment of the head strap in a reproducible manner simply by fastening the head strap in the way described above.

SUMMARY OF THE INVENTION

It is an object of this invention to provide swimming goggles having a head strap which shows the reduced tendency to come loose and can be adjusted in length in a reproducible manner.

To achieve this object, swimming goggles according to the present invention includes a pair of lens parts, a lens frame part configured to surround the lens part and having a rear end which extends rearward from an outer edge of the lens part, a head strap, and a means for fastening a longitudinal end of the head strap to the rear end of the frame part in a length adjustable manner.

The swimming goggles further includes the fastening means including a guide member around which the end of the head strap that extends from the rear toward the front of the swimming goggles can be passed so that it is turned to direct toward the rear, and a protrusion positioned rearward the guide member and extending either inwardly or outwardly of the swimming goggles, and that the head strap having at the end a plurality of through-holes arranged in a lengthwise direction and each extending through the head strap between inward and outward faces of the head strap for receiving the protrusion in a releasable manner.

DETAILED DESCRIPTION OF THE PREFERRED EMBODIMENTS

The swimming goggles in accordance with this invention is below described in detail with reference to the attached drawings.

Figure 1:
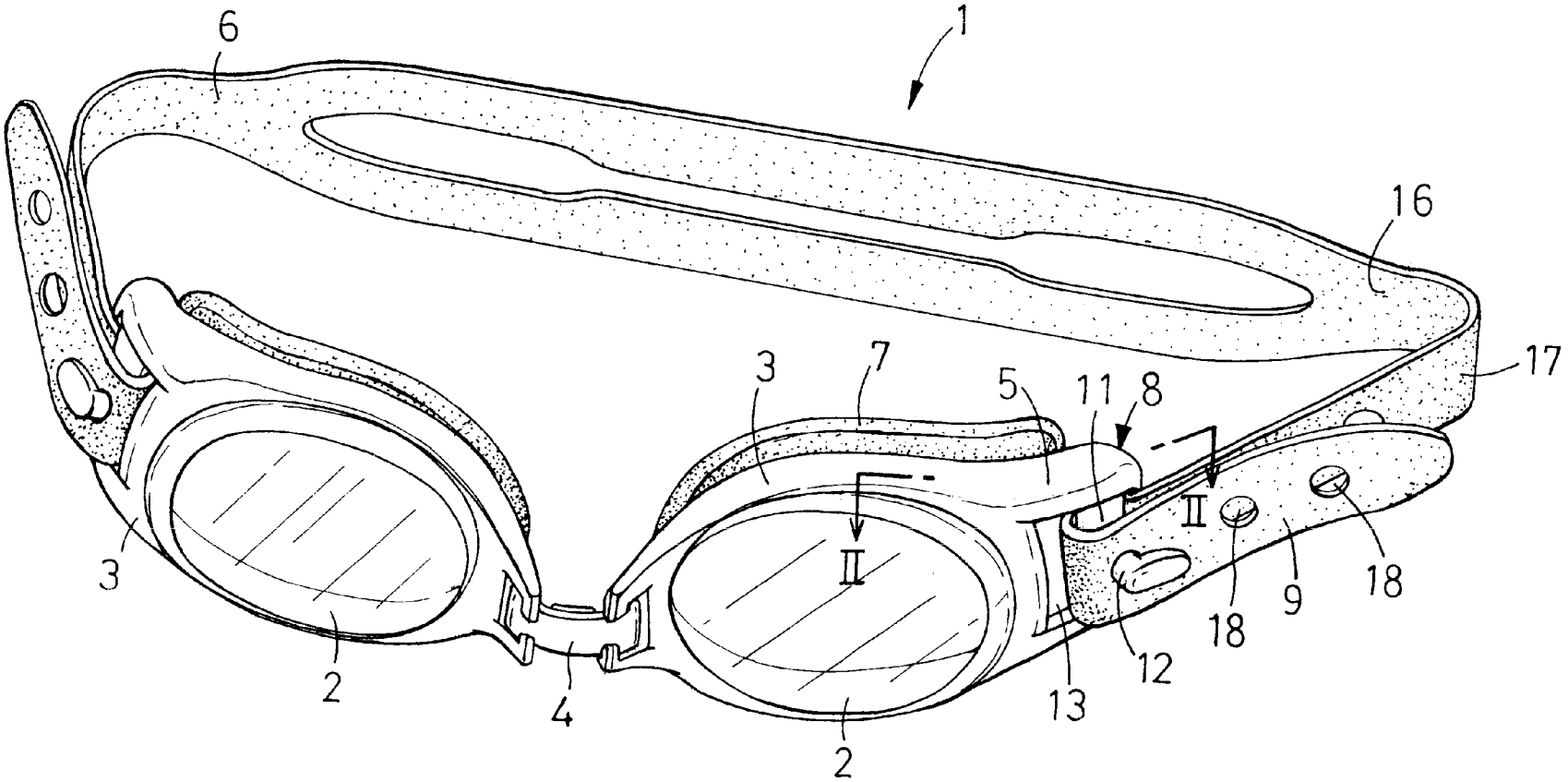
FIG. 1 is a perspective view of swimming goggles.

Swimming goggles 1 shown in FIG. 1 by a perspective view include a pair of lenses 2, lens frames 3 for encircling respective lenses 2 in an engaged manner, a nose belt 4 for connecting a pair of lens frames 3 at their inner ends, a head strap 6 connecting the pair of lens frame 3 at their rear ends 5, and a cushion pad 7 attached to an inward face of each lens frame 3. A means 8 for fastening the head strap 6 is provided at the rear end 5 of each lens frame 3 that extends rearward from an outer edge of the lens 2. This means 8 includes a guide member 11 around which a longitudinal end 9 of the head strap 6 extending from the rear can be passed so that it is turned back to direct toward the rear, an outwardly-extending protrusion 12 positioned rearward the guide member 11, and an insertion slot 13 provided right in front of the guide member 11. Preferably, the insertion slot 13 is configured to have a length dimension equal to or smaller than a width dimension of the end 9 of the head strap. The head strap 6 has an inward face 16 and an outward face 17. A plurality of through-holes 18 each passing the end 9 between the inward face 16 and outward face 17 are arranged longitudinally in a row.

Figure 2:
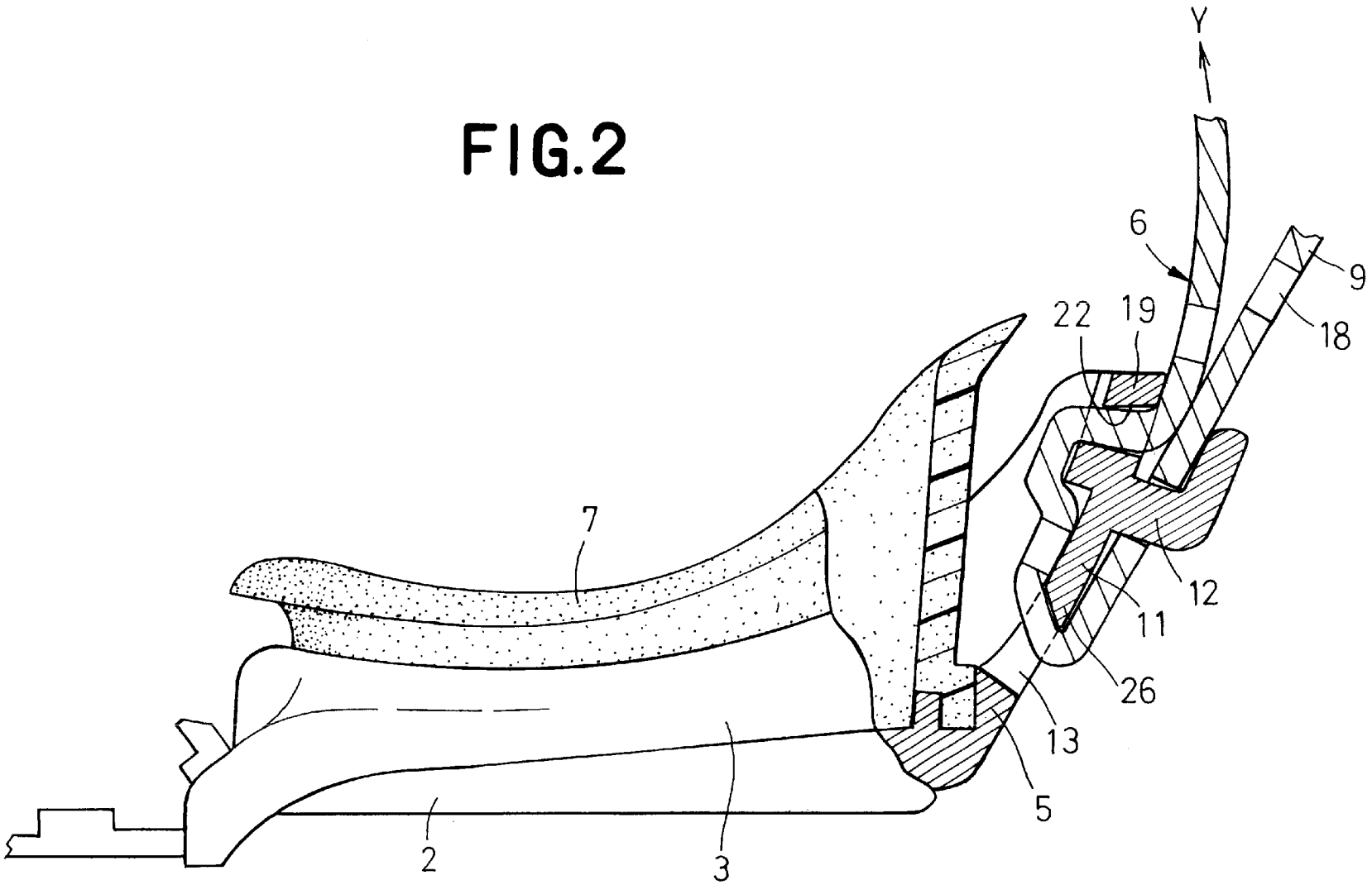
FIG. 2 is a view taken along the arrow-headed line II—II with a part being cut away to show a section.

FIG. 2 is a view taken along the arrow-headed line II—II with a part being cut away to show a section. The lens frame 3 has at its rear end 5 a post 19 positioned rearward the guide member 11 to extend parallel thereto and a second insertion slot 22 defined between the guide member 11 and the post 19. The head strap end 9 extending from the rear toward the front of the swimming goggles 1 is first passed through the second insertion slot 22, next through the insertion slot 13 while turned to direct toward the rear, and the protrusion 12 is inserted in any one of the through-holes 18 provided at the turn-back portion. The preferred head strap 6 is elastically stretchable such that it readily receives the protrusion 12. However, the protrusion 12, once inserted, is hard to come out from the head strap 6 because the protrusion is L-shaped at its top. The protrusion 12 may be provided in plurality on the lens frame 3 to line in its vertical or longitudinal direction. In such a case, through-holes 18 may also be provided in the head strap 6 for receiving respective protrusions 12.

The head strap 6 can be adjusted in length by inserting the protrusion 12 into any suitable one of the plural through-holes 18. The head strap 6 when worn by a swimmer is subjected to a tension that acts in the direction of the arrow Y shown in FIG. 2. However, since the head strap 6 while folded along the guide member 11 is brought into a firm contact with its front end 26, a portion of the head strap 6 that has been turned back is little affected by the tension. For the same reason, the tension is prevented from concentrating at a head strap region surrounding the through-hole 18 into which the protrusion 12 has been inserted, so that a damage of the head strap 6 adjacent the through-hole 18 can be avoided. When such a damage is concerned, the head strap 6 may be made extra thick only at its regions surrounding the through-holes 18. In the preferred guide member 11, the front end 26 is configured to slant at an acute angle, like the shown embodiment. In the further preferred guide member 11, saw-tooth wave undulations 29 are formed on its front end 26 to prevent slippage of the head strap 6 (see FIG. 4). The undulations 29 operate such that the head strap 6 is caused to conform to the undulations 29 as the head strap 6 is pulled strongly in the Y direction. Also, the insertion slot 13 is configured to have a length dimension equal to or smaller than a width dimension of the head strap 6. Accordingly, the head strap 6 when pulled slides along a periphery of the insertion slot 13 so that the magnitude of the tension exerted on the turn-back portion of the head strap 6 diminishes. When the head strap 6 passes through a second insertion slot 22, the head strap 6 comes into contact with the lens frame 3 while it makes bends. This also reduces the influence of the tension on the turn-back portion of the head strap 6 when the swimming goggles 1 are worn.

If the swimming goggles 1 are such constructed, an initial operative length of the head strap 6 is kept unchanged. Also, the head strap 6 once released from the stopper portion 8 can be readily readjusted to the initial operative length.

Figure 3:
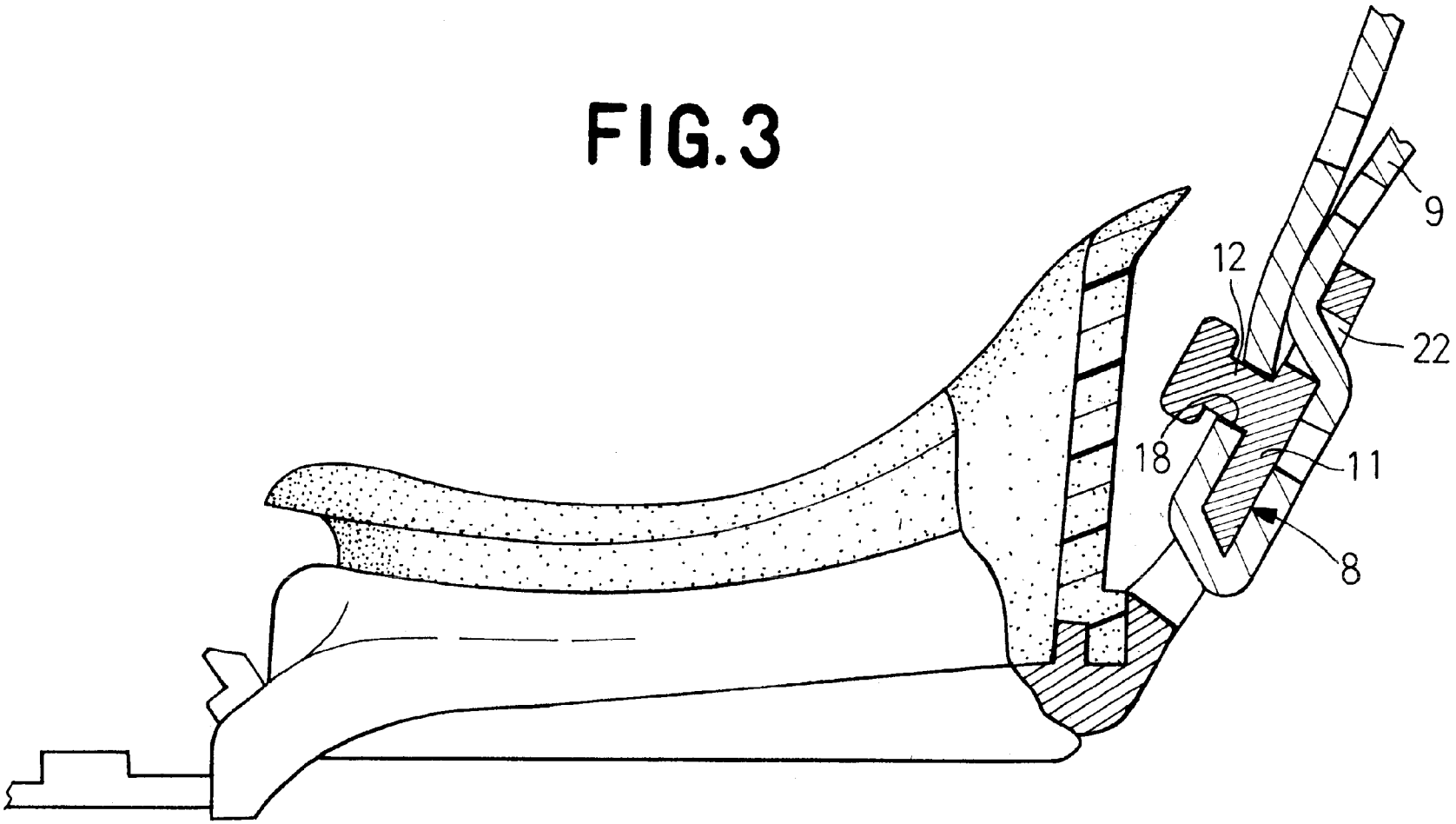
FIG. 3 is a drawing drafted in a manner similar to FIG. 2 to show an exemplary embodiment.

FIG. 3 is a drawing drafted in a manner similar to FIG. 2 to show an exemplary embodiment of this invention. In this swimming goggles 1, the protrusion 12 positioned rearward the guide member 11 extends inwardly of the swimming goggles 1. After insertion of the protrusion 12 in the through-hole 18, the leading end 9 of the head strap that extends from the rear is passed around the guide member 11 and further through the second insertion slot 22. The protrusion 12 is configured such that its distal end has a larger diameter relative to its proximal end. This prevents easy escape of the protrusion from the head strap 6. Besides the inwardly-extending protrusion 12, the swimming goggles 1 may also have another protrusion 12 that extends outwardly.

Figure 4:
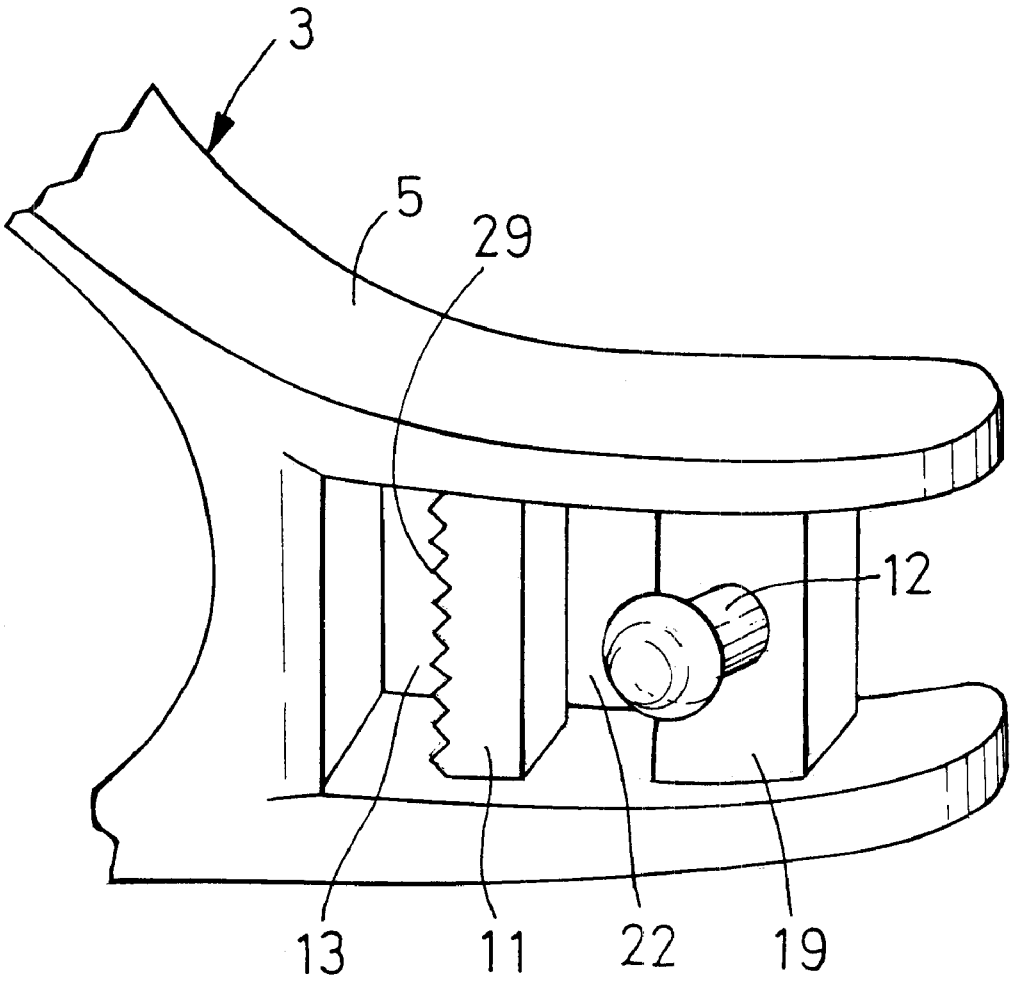
FIG. 4 is a partial perspective view of a lens frame, showing another exemplary embodiment.

FIG. 4 is a perspective view of a rear end 5 of the lens frame, illustrating one exemplary embodiment of the present invention. In the swimming goggles 1 of this case, the undulations 29 are formed at the front portion 26 of the guide member 11 to reduce slippage of the head strap, and the protrusion 12 to be positioned rearward the guide member 11 is provided on the post 19. In such a structure of the swimming goggles 1, the leading end 9 of the head strap may be passed through the insertion slot 13 and then turned back. Instead, it may be passed through the second insertion slot 22 and then turned back. The operative length of the head strap 6 can be adjusted by a suitable choice among the through-holes 18 in the head strap 6 or between the insertions slots 13, 22 at the rear end 5 of the lens frame.

In this invention, the rear end 5 of the lens frame can be constructed from two separable, front and rear members. In such a case, the means 8 for fastening the strap 6 may be provided in the rear member. This invention can also be practiced for the swimming goggles which are different from the shown exemplary embodiment in the respect that the lens frame 3 is integrally formed with the lens 2. Also, the lens frame 3 of this invention does not necessarily surround an entire periphery of the lens 2 and can be configured to surround only a part of its periphery. The nose belt 4 becomes unnecessary when the swimming goggles 1 include left and right lens frames 3 or left and right lens 2 integrally formed with each other.

The swimming goggles in accordance with this invention are constructed such that the leading end of the head strap can be passed around the guide member provided at the rear end of the lens frame and the protrusion positioned rearward the guide member can be inserted in the through-hole provided in the head strap. Accordingly, the head strap once fastened to the swimming goggles is hardly loosened. Also, the head strap 6, even if once released from the swimming goggles 1, can be readily readjusted to the initial operative length.

What is claimed is:

1. Swimming goggles including a pair of lens parts, a lens frame part configured to surround said lens part and having a rear end which extends rearward from an outer edge of the lens part, a head strap and a means for fastening a longitudinal end of said head strap to the rear end of the frame part in a length-adjustable manner;

said fastening means including a guide member around which the end of the head strap that extends from the rear toward the front of said swimming goggles can be passed so that it is turned to direct toward the rear, and a protrusion positioned rearward the guide member and extending either inwardly or outwardly of the swimming goggles; and said head strap having at the end a plurality of through-holes arranged in a lengthwise direction and each extending through the head strap between inward and outward faces of the head strap for receiving said protrusion in a releasable manner.

2. The swimming goggles of claim 1 wherein said guide member has at its surface a region that reduces slipping of the head strap portion that has been passed.

3. The swimming goggles of claim 1, wherein said rear end of the frame part has an insertion slot positioned right in front of the guide member for passing the end of the head strap therethrough.

4. The swimming goggles of claim 1, wherein said insertion slot is configured to have a lengthwise dimension equal to or smaller than a width dimension of said end of the head strap.

* * * * *